US006189617B1

(12) United States Patent
Sorhus et al.

(10) Patent No.: US 6,189,617 B1
(45) Date of Patent: Feb. 20, 2001

(54) HIGH VOLUME SAND TRAP AND METHOD

(75) Inventors: Atle Sorhus, Hinna; Inge Hjorteland, Tananger; Halvor Ronneseth; Frans Hazenberg, both of Stavanger, all of (NO)

(73) Assignee: Baker Hughes Incorporated, Houston, TX (US)

( * ) Notice: Under 35 U.S.C. 154(b), the term of this patent shall be extended for 0 days.

(21) Appl. No.: 09/196,536

(22) Filed: Nov. 20, 1998

Related U.S. Application Data

(60) Provisional application No. 60/066,774, filed on Nov. 24, 1997.

(51) Int. Cl.[7] ..... E21B 37/00; E21B 3/18

(52) U.S. Cl. ..... 166/311; 166/162; 166/227

(58) Field of Search ..... 166/227, 74, 56, 166/311, 69, 117, 162, 265, 105.1, 99

(56) References Cited

U.S. PATENT DOCUMENTS

| | | | | |
|---|---|---|---|---|
| 1,466,773 | * | 9/1923 | Trew | 166/105.1 |
| 2,663,370 | | 12/1953 | Donnell et al. | 166/99 |
| 2,797,755 | | 7/1957 | Bobo | 175/312 |
| 3,023,810 | * | 3/1962 | Anderson | 166/99 |
| 3,198,256 | | 8/1965 | Kirby, II | 166/99 |
| 3,382,925 | | 5/1968 | Jennings | 166/99 |
| 4,059,155 | | 11/1977 | Greer | 166/301 |

(List continued on next page.)

FOREIGN PATENT DOCUMENTS

| | | |
|---|---|---|
| 1 562 559 | 3/1980 | (GB) . |
| 2 221 486A | 2/1990 | (GB) . |

OTHER PUBLICATIONS

Baker Oil Tools Fishing Services General Catalogue, Boot Basket, p. 25 (undated).
Composite Catalogue 90–91, The Red Baron, Junk Subs (Boot Baskets) (undated).
Baker Oil Tools Fishing Services General Catalogue, Globe Type Junk Basket, p. 26 (undated).
Baker Oil Tools Fishing Services General Catalogue, Hydraulic Junk Basket, p. 27 (undated).
Composite Catalogue, Houston Engineers, Inc., Jet Junk Basket, p. 16 (undated).
Composite Catalogue, Bowen Oil Tools, Bowen Reverse Circulation Junk Baskets, p. 34 (undated).
Composite Catalogue, Bowen Oil Tools, Bowen Full–Flow Reverse Circulation Junk Baskets, p. 35 (undated).

(List continued on next page.)

*Primary Examiner*—David Bagnell
*Assistant Examiner*—Jennifer R Dougherty
(74) *Attorney, Agent, or Firm*—Duane, Morris & Heckscher LLP

(57) ABSTRACT

A sand-capturing tool is disclosed, as well as a method. The tool relies on an eductor. The eductor is supplied by pumped fluid from the surface through a coiled tubing support for the tool. The eductor induces flow into a central tube in the tool which brings in with it the sand to be captured. Ultimately, the cross-sectional area of the induced fluid flow is increased to reduce its velocity and to further induce the sand which has been brought through the narrow inner tube to drop out into an annular area around the inner tube. The clean fluid exits through a screen and goes around the eductor and uphole to the surface. In an alternative embodiment, the assembly can be supported on an electric line employing a downhole pump which provides the motive fluid force for the eductor jet. In this embodiment, the remaining operation is the same.

20 Claims, 3 Drawing Sheets

U.S. PATENT DOCUMENTS

| | | | | |
|---|---|---|---|---|
| 4,284,306 | * | 8/1981 | Edmonds et al. | 299/5 |
| 4,296,822 | | 10/1981 | Ormsby | 175/249 |
| 4,744,420 | | 5/1988 | Patterson et al. | 166/312 |
| 4,984,633 | * | 1/1991 | Langer et al. | 166/241.1 |
| 5,095,976 | * | 3/1992 | Appleton | 166/105.1 |
| 5,156,206 | * | 10/1992 | Cox | 166/242.2 |
| 5,176,208 | | 1/1993 | Lalande et al. | 166/99 |
| 5,295,537 | * | 3/1994 | Trainer | 166/105.1 |
| 5,374,163 | * | 12/1994 | Jaikaran | 417/172 |
| 5,402,850 | | 4/1995 | LaLande et al. | 166/301 |
| 5,447,200 | | 9/1995 | Dedora et al. | 166/311 |
| 5,662,167 | * | 9/1997 | Patterson et al. | 166/265 |
| 5,682,950 | | 11/1997 | Bjørnstad | 166/99 |

OTHER PUBLICATIONS

Baker Oil Tools Fishing Services General Catalogue, Combination Ball Type Jet and Junk Basket, p. 28 (undated).
Baker Oil Tools Fishing Services General Catalogue, Jet Bushing, p. 29 (undated).
Baker Oil Tools Fishing Services General Catalogue, "M" Reverse Circulating Tool, p. 30 (undated).

* cited by examiner

HIGH VOLUME SAND TRAP AND METHOD

This application claims the benefit of U.S. Provisional application Ser. No. 60/066,774 filed on Nov. 24, 1997.

FIELD OF THE INVENTION

The field of this invention relates to devices and techniques for removal of sand from a wellbore to facilitate further production.

BACKGROUND OF THE INVENTION

The problem of sand production into a wellbore is illustrated in FIG. 1. As shown in FIG. 1, the upper casing 10 supports middle casing 12, which in turn supports a lower casing 14. The support mechanism is typically a hanger 16, which is of atype well-known in the art. Inside the wellbore W, formed by the casing sections 10, 12, and 14, is the production tubing 18, which extends through a packer 20. Casing 14 can be closed off by a bridge plug 22. Casing 14 is perforated, as indicated by perforations 24. This is accomplished by perforating guns of known design or by other means. Thus, the producing zone 26 communicates with the wellbore W through the perforations 24. Eventually, the fluids produced from the zone 26 bring sand 28 into the wellbore, as shown in FIG. 1.

In the past, there have been numerous techniques that have been used to try to remove the sand 28 from the wellbore W. In one technique, the packer 20 can be pulled and with it the tubing string 18. Thereafter, coiled tubing can be run in the wellbore to the zone adjacent the sand 28 and vigorous circulation through pumping through the coiled tubing initiated in an effort to get the sand to come up to the surface. The problem with this technique is that it is time-consuming and generally ineffective. The reason is that as the fluid exits the coiled tubing and agitates the sand 28, it may be successful in moving the sand 28 uphole to a certain extent. However, as the casing sections become bigger, the velocity uphole in the wellbore W decreases and precipitates the sand. Thus, using this technique, very little sand is effectively removed.

U.S. Pat. No. 4,924,940 illustrates another technique for removal of sand from a wellbore. Here, a design involving multiple flapper-type valves and a reciprocating piston are used to bring the sand within the valves where it is trapped. This device can be combined with a retrievable packer to isolate a portion of the wellbore for accomplishing the sand collection below. This design involves numerous moving parts and is fairly complicated to assemble and effectively operate. A related design of the Cavins Corporation, referred to as the "Sand Trap Downhole Desander" employs a seal to isolate the wellbore, below which are a series of inlet slots. Internally, the device uses a liquid cyclone effect to separate sand entrained in the liquid. A downhole pump is part of the bottomhole assembly and its suction draws out the fluid out the top, with the sand being captured at the bottom. The fluid with the sand flows down and then makes a turn up to get into the pump.

Other devices rely on a jetting or eductor action such as the Baker Oil Tools combination ball-type jet and junk basket, Product No. 130-97. This product has a series of movable members which are deflected by the junk which is brought into the basket region. The eductor induces flow through the bottom of the tool, past the pivoting fingers which form the basket. This tool is generally designed to catch larger debris such as cuttings from milling packers and other downhole equipment that needs to be removed from the wellbore. This product, when used for sand, will generally allow some of the captured sand to pass back out through the pivoting segments that form the basket. Additionally, if circulation is stopped, sand can get behind the pivoting segments, thus preventing them from opening all the way to facilitate flow therethrough.

Another product from Baker Oil Tools is a combination of a jet bushing, Product No. 130-96, and an internal boot basket, Product No. 130-21. When combined, a jet action is used to induce fluid flow into the tool laden with sand. The internal boot basket has a series of inclined plates which create a circuitous path for the fluid induced into the housing through the action of the jet or eductor. While making the various twists and turns so that the fluid can exit the tool, the sand drops out and is caught on the inclined internal plates. The various internal boot basket sections are threaded through each other and ultimately to the jet bushing. An internal screen is provided for the fluid exiting the tool. The exit of the tool goes around the jet and back into the annulus.

Yet another design from Baker Oil Tools is the Model M reverse circulating tool which employs a cup seal to close off the wellbore, and a reverse circulating Towpath below the cup seal which brings into the central bore of the tool the reverse circulating fluid laden with the debris to be trapped within the body of the tool. Ultimately, the reverse circulating fluid exits the body of the tool above the cup seal and flows to the surface in the annulus. This tool employs the junk basket design previously designed for the other Baker Oil Tools models or other modified designs relying on the principal of velocity reduction to precipitate the sand.

What has been lacking in these prior designs is a tool that can be assembled and disassembled quickly. Rig time is a significant concern in view of the ever-increasing daily rates now being charged. Thus, these prior designs, which were put together by attaching threaded components, took significant times to assemble for run-in and to disassemble when filled and brought to the surface. Thus, it is one object of the apparatus and method of the present invention to be able to assemble the tool for run-in quickly and disassemble it upon retrieval in short order so as to reduce required rig time.

It is a further object of the invention to be able to run the sand retrieval tool through tubing, supported on coiled tubing or on electric line. It is a further object of the invention to provide a simple design with the fewest number of parts that move so that reliable operation can be achieved. Those and other benefits of the apparatus and method of the present invention will be appreciated by those of ordinary skill in the art by a review of the description of the preferred embodiment below.

SUMMARY OF THE INVENTION

A sand-capturing tool is disclosed, as well as a method. The tool relies on an eductor. The eductor is supplied by pumped fluid from the surface through a coiled tubing support for the tool. The eductor induces flow into a central tube in the tool which brings in with it the sand to be captured. Ultimately, the cross-sectional area of the induced fluid flow is increased to reduce its velocity and to further induce the sand which has been brought through the narrow inner tube to drop out into an annular area around the inner tube. The clean fluid exits through a screen and goes around the eductor and uphole to the surface. In an alternative embodiment, the assembly can be supported on an electric line employing a downhole pump which provides the motive fluid force for the eductor jet. In this embodiment, the remaining operation is the same.

DETAILED DESCRIPTION OF THE PREFERRED EMBODIMENT

Figure 1:
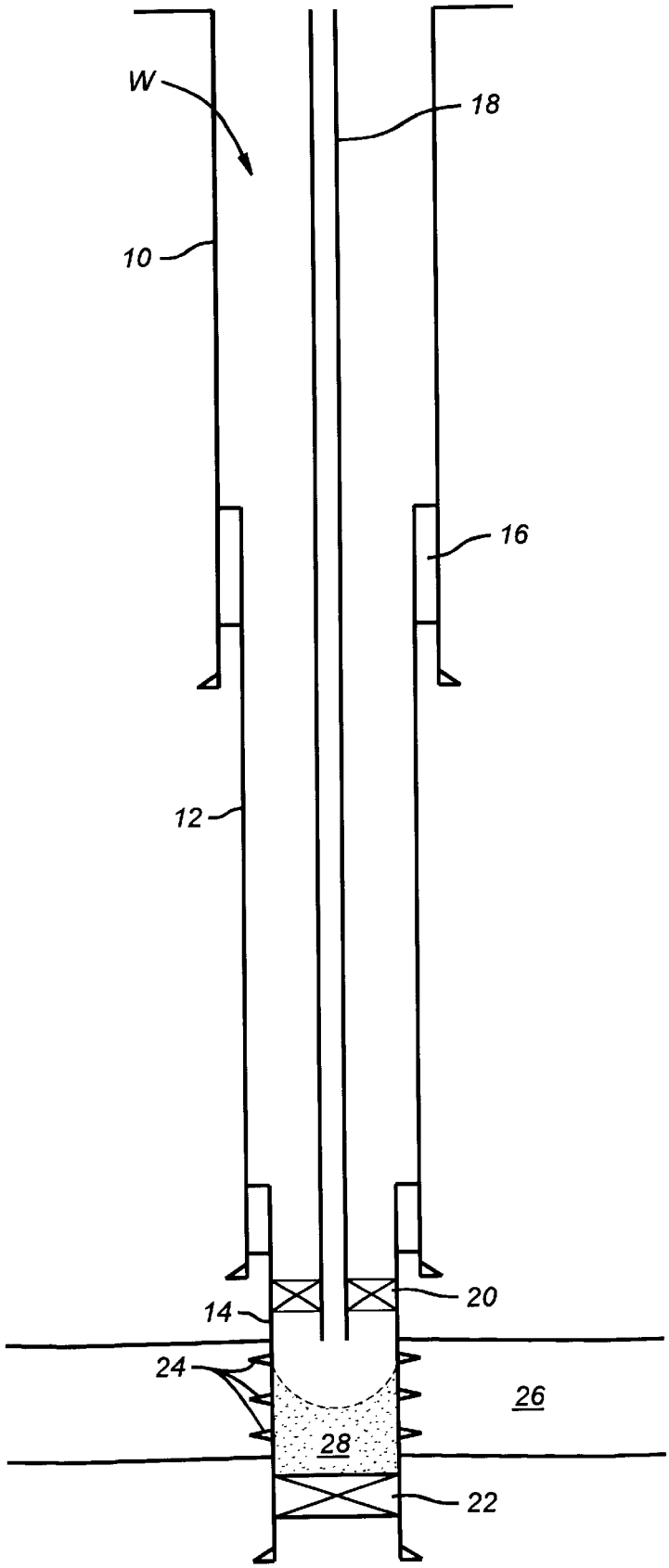
(PRIOR ART) FIG. 1
FIG. 1 is an overall view in section of a typical wellbore, showing sand within the wellbore to be removed.
Figure 2:
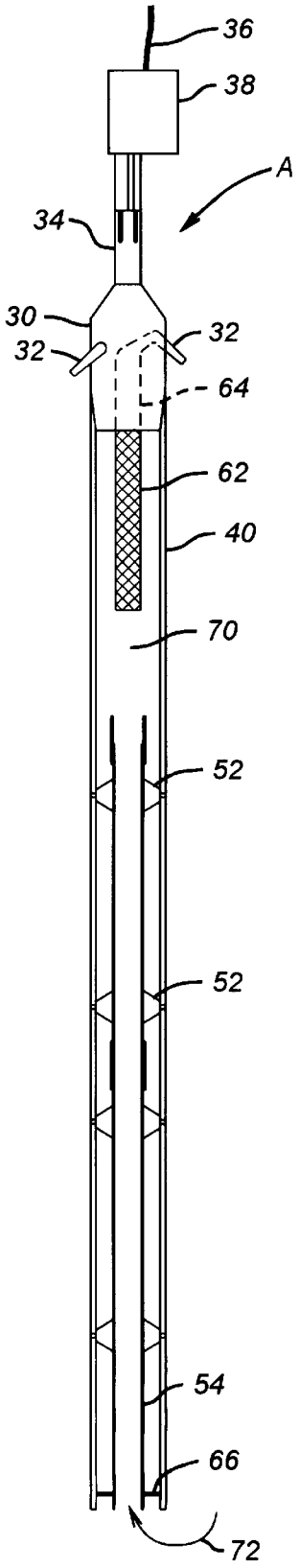
FIG. 2 is a schematic representation of the tool of the present invention in section.
Figure 5:
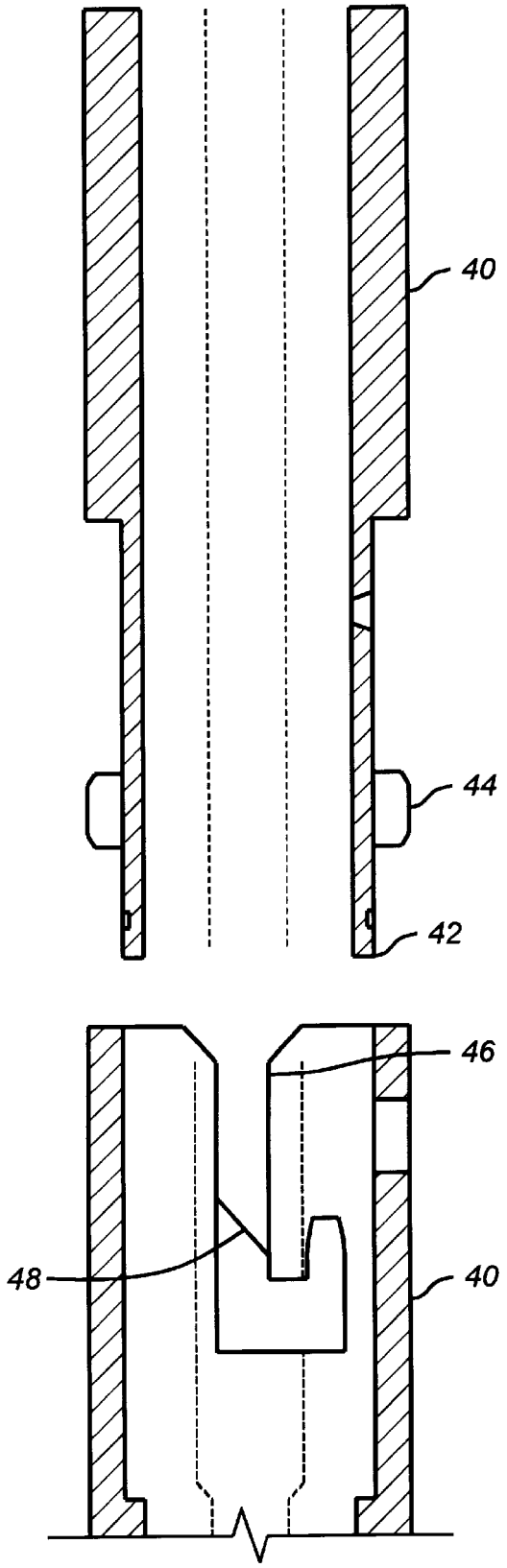
FIG. 5 a detail of the connection of tubing segments 40.

Referring to FIG. 2, the apparatus A of the present invention is schematically illustrated. The upper body 30 includes jets 32 that can be supplied by flowing fluid through coiled tubing 34. In one embodiment, the coiled tubing can run to the surface so that the apparatus A, which is insertable through the tubing string 18 (see FIG. 1), can be actuated with pump pressure from the surface. An alternative design is to suspend the upper body 30 by an electric line 36, which is in turn connected to a downhole pump 38. The electric line 36 provides the power to operate the pump 38 so that fluids downhole can be pumped up and conducted into the upper body 30 to operate the jets 32. Thus, FIG. 2 schematically illustrates both embodiments of operation of the jets 32. In either case, the entire assembly is insertable through tubing 18. The upper body 30 is connected to tubing segments 40, one of which can be more clearly seen in FIG. 3. When assembled together, as shown in FIG. 5, the lower end 42 of one segment 40 has a pin 44, which is meant to engage a J-shaped slot 46. Illustrated schematically is a catch 48 to keep the pin 44 in the slot 46. Other techniques for quickly joining the tubing segments 40 together can be employed without departing from the spirit of the invention. The important thing is that the tubing segments can be made up by a setdown force to eliminate the process of threading them together, which is time-consuming and, therefore, expensive in view of the high cost of rig time.

Figure 3:
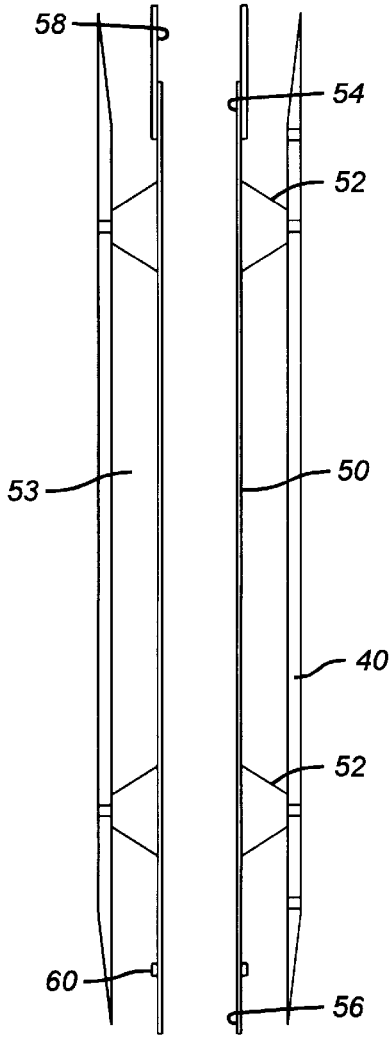
FIG. 3 is a detail of a portion of the lower end of the tool shown in FIG. 2, also in section.

Referring to the tubing segment 40 shown in FIG. 3, it can be seen that each tubing segment has an internal tube 50, which is spaced from the tubing segment 40 by one or more stabilizers 52, which separate the inner tube 50 from the tubing segment 40 and create an annular space 53 within the tubing segment 40. The inner tubes 50 have on their ends 54 and 56, respectively, a coupling 58 and a teflon® ring 60. Thus, as to end 56, another coupling (not shown) from below will go over the teflon® ring 60. In essence, the assembly of tubes that make up the internal tube 50 go together in a sealing fashion by setting one tube segment 50 on top of the other. The tubing segments 40 are basically also set down on each other but are locked together by a J-slot mechanism or any other bayonet-type assembly that eliminates the need for threading equipment to be used during rig-up and rig-down of the apparatus A. Because of this type of construction, the entire apparatus A can be put together very quickly, as well as taken apart in a quick fashion.

Referring back to FIG. 2, an internal screen 62 is mounted to upper body 30 and is in communication with passage 64.

The bottom end of the annular space 53 is closed off by an internal ring 66.

Figure 4:
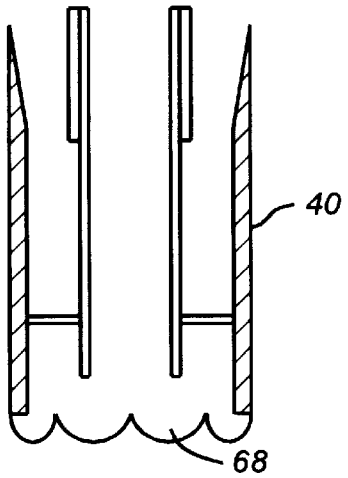
FIG. 4 is the lower end of the tool shown in FIG. 2, also in section.

The lower end of the apparatus A is shown in FIG. 4, indicating that the lowermost tube segment 40 has a scalloped lower end 68 so that it can plant itself in the sand 28 to be removed (see FIG. 1).

The essential components of the apparatus now having been described, its operation will be reviewed. If the apparatus A is run through the tubing 18 on coiled tubing, the surface pumps are kicked on and circulation begins through the coiled tubing and into the upper body 30. Flow ultimately exits out the eductors or jets 32, thus creating a reduced pressure in zone 70. Fluid laden with sand, as represented by arrow 72, enters the stack of inner tubes 50. Due to the reduction in cross-sectional area, the velocity increases within the tubes 50 until zone 70 is reached, at which time the particles of sand precipitate out into annular space 53, where they are caught by plate 66. The remaining fluid passes through the screen 62 and out through passage 64, at which time it is sucked into the eductor assembly 32 and exhausted into the annular space around the apparatus A within the tubing 18.

Thus, the apparatus of the present invention, as described above, can be assembled and disassembled quickly, saving precious rig time. Additionally, the use of the annular space 53 provides a large reservoir for captured sand or other metal debris as a result of milling. The assembly is easy to put together and, in view of the use of an annular collection reservoir, is effective in removal of the sand and its capture. The high velocity within the tube 50 keeps the sand entrained until entering zone 70, at which time it can drop down into the annular space 53. When the sand is removed or the space 53 is full, the assembly is raised to the surface for removal of the sand.

The operation of the alternative embodiment run on electric line is a further advantage because on many rigs, a coiled tubing unit may not be available. However, on most rigs an electric line is available such that the assembly can be run through tubing 18 with a downhole pump which will provide the motive force for the eductor 32. The eductor assembly 32 is of a type known in the art and has been described in the background of the invention. The seals between the segments 50 can be made of a variety of materials without departing from the spirit of the invention. The connection techniques for the tubing segments 40 can be of a variety of different types as long as they eliminate the threading requirement which takes considerable rig time for each joint. Since no rotation is involved in the function of the apparatus A, joints such as bayonet types can be used without departing from the spirit of the invention.

The foregoing disclosure and description of the invention are illustrative and explanatory thereof, and various changes in the size, shape and materials, as well as in the details of the illustrated construction, may be made without departing from the spirit of the invention from the spirit of the invention.

What is claimed is:

1. An apparatus for capturing downhole contaminants through tubing in a well, comprising:

an elongated body defining a chamber therein;

at least one tubing segment releasably attached to said body without threading:

said tubing segment having an open lower end adjacent from which an open ended tubular inlet tube extends longitudinally toward said chamber and defines an annular retention compartment around itself, said compartment extending to adjacent said lower end of said tubing segment;

said compartment extendable without threading by an additional tubing segment having therein its own tubular inlet tube which connects without threading to said tubular inlet tube already supported from said tubing segment;

a pressure-reduction device acting on said chamber to draw fluid laden with contaminants through said inlet tube and into said chamber for deposit of the contaminants in said retention compartment.

2. The apparatus of claim 1, wherein:

said tubing segment is attachable to said body with a pin-in-slot connection.

3. The apparatus of claim 2, wherein:

said tubing segment comprises a plurality of modular components attachable to each other and to said body without threading.

4. The apparatus of claim 1, wherein:

said tubing segment comprises a plurality of modular components, each comprising an inlet tube and wherein said inlet tubes are attachable to each other and one component of said tubing segment is attachable to said body without threading.

5. The apparatus of claim 4, wherein:

each said tubing segment further comprises a pin near one end and a slot near the opposite end.

6. The apparatus of claim 5, wherein:

each said inlet tube comprises a coupling on at least one end thereof to engage an inlet tube of an adjacent tubing segment when said adjacent tubing segments are connected by said pin-and-slot connection.

7. The apparatus of claim 6, wherein:

each said inlet tube comprises a seal near one end opposite said coupling, whereupon joining tubing segments together, a seal from one inlet tube extends sealingly into a coupling on an adjacent inlet tube.

8. The apparatus of claim 7, further comprising:

a stabilizer to position said inlet tube in its respective tubing segment.

9. The apparatus of claim 8, further comprising:

a scalloped bottom on the lowermost of said tubing segments; and a ring-shaped member acting as a bottom to said retention compartment by spanning across the annular gap between said tubing segment and said inlet tube in the lowermost of said tubing segments.

10. The apparatus of claim 1, further comprising:

at least one eductor to induce flow through tubular inlet tube and into said chamber;

a screen to catch solids which do not drop into said retention compartment due to a velocity reduction when fluid laden with contaminants enters said chamber.

11. The apparatus of claim 10, further comprising:

a tubing string extending from the surface to direct motive fluid to said eductor.

12. The apparatus of claim 10, further comprising:

a downhole pump connected to said elongated body for insertion through tubing on wireline or electric line.

13. A method of removing contaminants from a well bore through tubing, comprising:

assembling an elongated body having an internal chamber and at least one pressure-reduction device for the chamber;

connecting, without threading, a tubing segment to the body;

providing an inlet tub in the tubing segment which extends from adjacent the lower end of said inlet tube and for the substantial length of said inlet tube;

configuring said inlet tube and tubing segment to accept without threading another tubing segment with an inlet tube therein to expand the volume for catching contaminants;

lowering the assembled elongated body and tubing segment through tubing to a location near the contaminants;

using the pressure-reduction device to draw well fluid and contaminants through the inlet tube into the chamber;

catching contaminants in the tubing segment, outside the inlet tube.

14. The method of claim 13 further comprising:

using a pin and slot to connect the tubing segment to the elongated body.

15. The method of claim 14, further comprising:

using a plurality of tubing segments each having an inlet tube, said tubing segments are connectable to each other by pin-and-slot connections.

16. The method of claim 15, further comprising:

providing a seal on one end of each inlet tube and a coupling on the opposite end.

17. The method of claim 16, further comprising:

sealingly connecting an inlet tube in one tubing segment to an inlet tube in an adjacent tubing segment by insertion of one end of an inlet tube with the seal into a coupling on the adjacent inlet tube as a result of connecting tubing segments.

18. The method of claim 13, further comprising:

providing a greater cross-sectional area in the chamber than in the inlet tube;

slowing the velocity of fluid entering the chamber;

allowing contaminants to drop into an annular space outside the inlet tube.

19. The method of claim 13, further comprising:

running in the elongated body on tubing;

applying fluid pressure through the tubing supporting the elongated body;

providing an eductor as the pressure-reduction device;

using the applied fluid pressure to supply the eductor.

20. The method of claim 13, further comprising:

running in the elongated body attached to a downhole pump supported on a wireline or electric line;

providing an eductor as the pressure-reduction device;

supplying motive fluid pressure to the eductor with the downhole pump.

* * * * *